United States Patent [19]

Yerushalmi

[11] Patent Number: 4,889,258

[45] Date of Patent: Dec. 26, 1989

[54] BLAST-RESISTANT CONTAINER

[75] Inventor: Yaakov Yerushalmi, Petah Tikva, Israel

[73] Assignee: Koor Metals Ltd., Holon, Israel

[21] Appl. No.: 213,569

[22] Filed: Jun. 30, 1988

[30] Foreign Application Priority Data

Jul. 16, 1987 [IL] Israel ..... 83209

[51] Int. Cl.[4] ..... F42B 1/02

[52] U.S. Cl. ..... 220/429; 89/1.1; 102/303; 220/454

[58] Field of Search ..... 220/429, 453, 454; 206/524.1, 524.4, 583; 102/303; 89/1.1; 73/35

[56] References Cited

U.S. PATENT DOCUMENTS

| | | | |
|---|---|---|---|
| 2,780,350 | 2/1957 | Simon et al. | 220/429 X |
| 3,145,837 | 8/1964 | Lewis et al. | 220/429 X |
| 3,481,504 | 12/1969 | Nelson | 220/429 |
| 3,739,731 | 6/1973 | Tabor | 89/1.1 X |
| 3,820,435 | 6/1974 | Rogers et al. | 89/1.1 |
| 4,628,819 | 12/1986 | Backofen, Jr. et al. | 102/303 X |

*Primary Examiner*—Steven M. Pollard

*Attorney, Agent, or Firm*—Benjamin J. Barish

[57] ABSTRACT

A blast-resistant container for receiving an explosive or explosive-suspect article comprises a high-strength outer housing, and an inner compressible layer of a mixture including vermiculite in a binder, effective to space the article from the outer housing, to absorb energy of the blast before transmited to the outer housing, to distribute the blast forces over a larger surface area of the outer housing, and to impart resistance to the penetration of fragments to the outer housing.

18 Claims, 2 Drawing Sheets

FIG 3
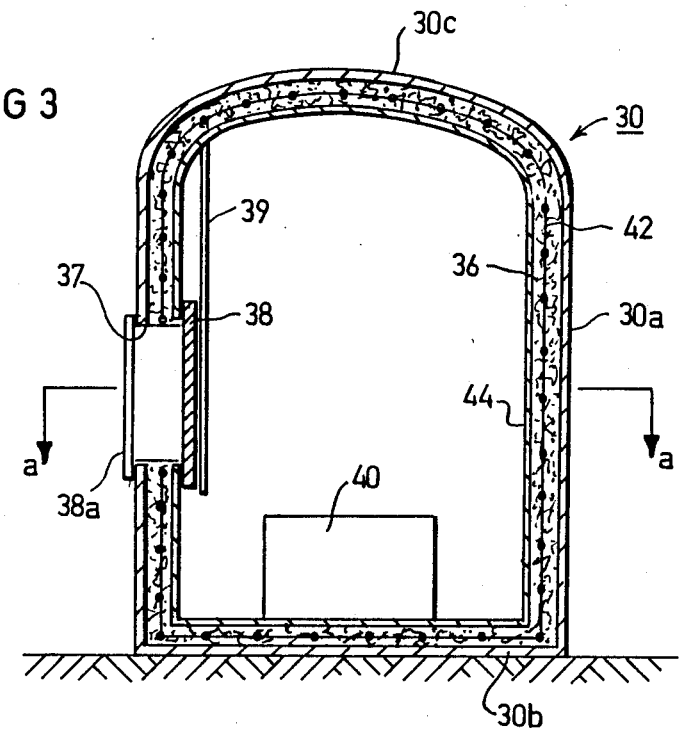
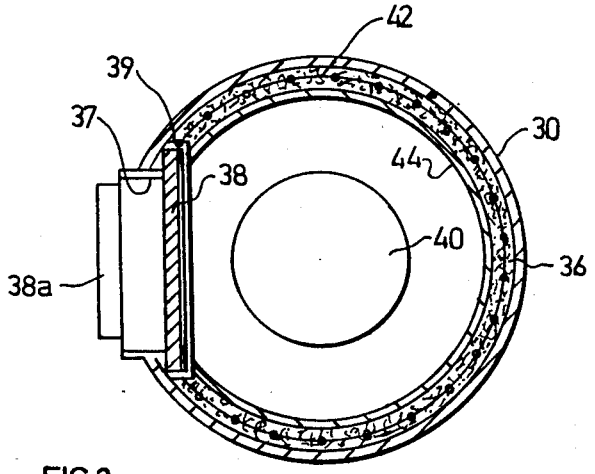
FIG 3a

BLAST-RESISTANT CONTAINER

BACKGROUND OF THE INVENTION

The present invention relates to blast-resistant containers, and particularly to such containers for receiving an explosive or explosive-suspect article, such as a hidden bomb, for preventing or minimizing damage in the event the article explodes.

Blast-resistant containers are now widely used for holding an explosive, or an explosive-suspect article, in order to either transport the article to a place where it can be safely detonated, or to permit its safe detonation within the container itself. The known blast-resistant containers presently in use are generally of thick heavy and bulky construction in order to be able to withstand the blast should the article placed within it explode.

An object of the present invention is to provide a blast-resistant container which is of simpler, lighter and less bulky construction than the blast-resistant containers heretofore used.

BRIEF SUMMARY OF THE INVENTION

According to the present invention, there is provided a blast-resistant container for receiving an explosive or explosive-suspect article, comprising: a high-strength outer housing; characterized in that said housing includes an inner compressible layer of a mixture including vermiculite in a binder effective to space the article from the outer housing, to absorb energy of the blast before transmitted to the outer housing, to distribute the blast forces over a larger surface area of the outer housing, and to impart resistance to the penetration of fragments to the outer housing.

Vermiculite is a micaceous hydrated silicate related to the chlorites and is normally used as heat insulation and/or for starting plant seeds and cuttings. Good results have been obtained when the vermiculite in th inner compressible layer of the present invention has an average small-dimension particle size of from 5 to 10 mm, and wherein the binder is plaster, or cement.

A compressible layer including vermiculite, plaster or cement, and water, has been found to be particularly effective wherein the vermiculite is present from 2:1 to 10:1 parts by volume. Decreasing the quantity of the vermiculite to a ratio of less than 2:1 produces high resistance to penetration of fragments but low absorption of the energy of the blast before it is transmitted to the outer housing; whereas increasing the ratio of the vermiculite over 10:1 produces high energy absorption but very little penetration resistance of the fragments. Best results have been obtained when the inner compressible layer was a mixture of about 6:1 of vermiculite and plaster or cement plus a quantity of water equal to about 10% in volume of the total mix.

Three embodiments of the invention are described below for purposes of example. In one described embodiment, the outer housing is open at the top and includes a removable cover closing its open top. This embodiment is particularly useful as a trash bin to be located in public places to provide some degree of protection to the public in case an explosive device is inserted into it. In two further described embodiments, the outer housing is formed with an opening in the side and includes a door which is movable to either an open position or to a closed position with respect to the side opening. Such a container construction is more particularly useful to hold an explosive-suspect article while being transported to a safe place for detonation, or for detonation within the container.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a vertical sectional view of a third form of blast-resistant container constructed in accordance with the present invention, FIG. 3*a* being a horizontal sectional view along line a—a of FIG. 3.

DESCRIPTION OF PREFERRED EMBODIMENTS

Figure 1:
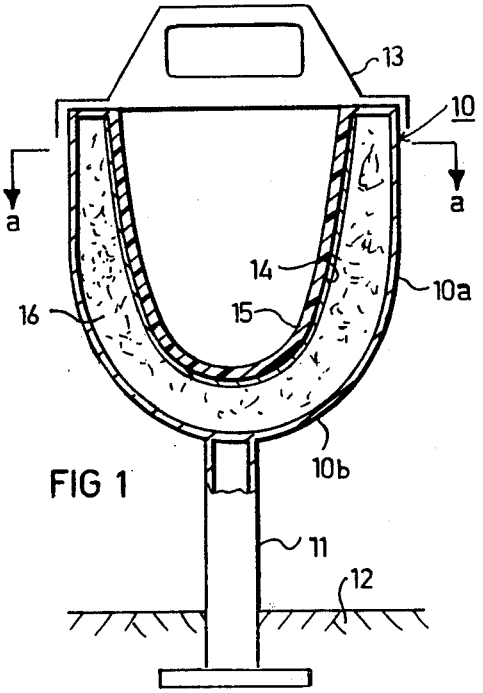
FIG. 1 is a vertical sectional view illustrating one form of blast-resistant container constructed in accordance with the present invention, FIG. 1*a* being a horizontal sectional view along line a—a of FIG. 1.
Figure 1A:
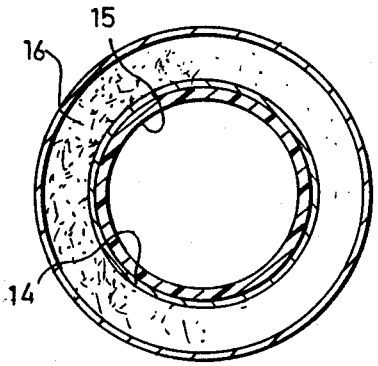

The container illustrated in FIGS. 1 and 1*a* is particularly useful as a rubbish bin for receiving rubbish at public locations and to provide some protection in case an explosive article is placed into it. It includes an outer high-strength housing 10 supported by a vertical leg 11 embedded in concrete 12. The high-strength outer housing 10 includes a cylindrical side wall **10*a*, a semi-spherical bottom wall 10*b*, and an open top which is closed by a removable cover 13**.

Disposed within the outer housing 10 is an inner liner 14 of dished construction and spaced from the outer housing 10. A rubbish basket 15 is supported on the inner liner 14 for receiving the rubbish introduced into the container, and is removable from the container in order to empty its contents.

As clearly seen in FIGS. 1 and **1*a*, the inner liner 14 is spaced from the outer high-strength housing 10. This space is occupied by the inner compressible layer 16 described earlier which is effective, to space the article placed within basket 15 from the outer housing 10, to absorb energy of the blast before transmitted to the outer housing 10 should the article explode, to distribute the blast forces over a larger surface area of the outer housing 10, and to impart resistance to the penetration of fragments to the outer housing 10**.

As one example, the outer housing 10 may be of steel plate 5 mm in thickness having a height of 60 cm and a diameter of 50 cm; the inner liner 14 may be of steel of 2 mm thickness; the removable rubbish basket 15 may be of a plastic material; the inner compressible layer 16 may be a mixture of vermiculite and plaster or cement in which the vermiculite is present in the ratio of 6:1 by volume of the plaster, the mixture including 10% water by volume of the mix; and the thickness of the inner compressible layer 16 may be about 8 cm.

Figure 2:
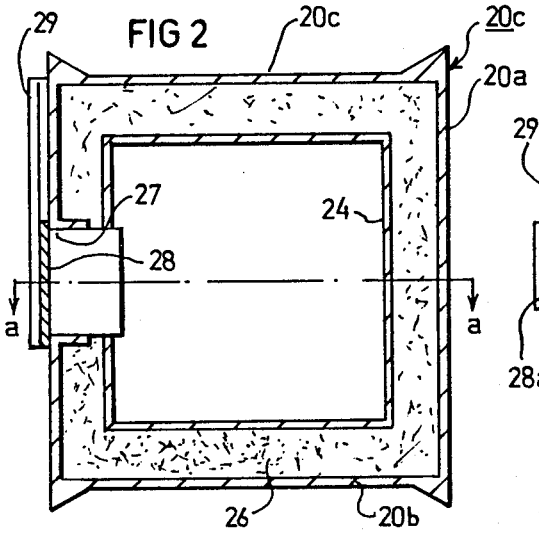
FIG. 2 is a vertical sectional view illustrating a second form of blast-resistant container constructed in accordance with the present invention, FIG. 2*a* being a horizontal sectional view along line a—a of FIG. 2.

FIGS. 2 and **2*a* illustrate another type of blast-resistant container particularly useful for transporting a bob, or an article that may be a bomb, to a location for detonation. The blast-resistant container illustrated in FIGS. 2 and 2*a* also includes an outer high-strength housing 20, an inner liner 24 spaced from the inner face of the outer housing, and an inner compressible layer 26 of particulate material in a binder, similar to layer 16 in FIGS. 1 and 1***a*.

Figure 2A:
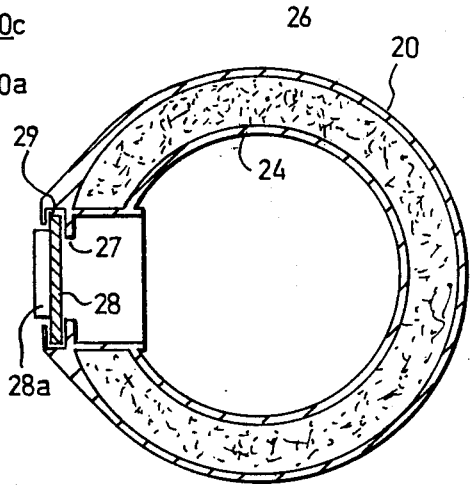

The outer housing 20 in the container of FIGS. 2 and 2*a* is also of cylindrical construction, including a cylindrical side wall 20*a*, but is closed at its bottom by a flat bottom wall 20*b*, and at its top by a flat top wall 20*c*. An opening 27 is formed in its side wall 20*a*, which opening is closed by a blast-resistant door 28 having an externally-projecting handle 28*a* for moving the door along rail 29 either to a lower position (illustrated in FIGS. 2, 2*a*) closing opening 27, or to a raised open position to permit access into the interior of the container.

As one example, the cylindrical side wall 20*a* of the outer housing 20 may be of a diameter of 60 cm, a length of 80 cm, and a thickness of 10 mm; the bottom and top walls 20*b* and 20*c* may be of steel having a thickness of 14 mm; and the inner compressible layer 26 may have a thickness of 15 cm. The latter layer is preferably a mixture of vermiculite particles in a plaster binder as described above, but may also be in another binder, such as a cement binder.

The blast-resistant container illustrated in FIGS. 3 and 3*a* is intended to be used for detonating the bomb within the container itself. Thus, the container illustrated in FIGS. 3 and 3*a* comprises an outer high-strength housing 30, and an inner compressible layer 36. The outer housing 30 in the container of FIGS. 3 and 3*a* is also of cylindrical construction, including a cylindrical side wall 30*a*, but in this case it includes a flat bottom wall 30*b* and a semi-spherical-top wall 30*c*. For providing access into the interior of the container, its side wall 30*a* is formed with an opening 37 closable by a blast-resistant and fragment-resistant door 38 having an externally-projecting handle 38*a* to facilitate moving the door either to its lower closed position (illustrated in FIGS. 3 and 3*a*) or to its raised upper position for providing access into the interior of the container. In this case, the blast-resistant door 38 is movable along rails 39 formed in the inner face of the outer housing 30,. but may be hingedly mounted.

In addition, the container is provided with a table 40 for receiving the suspected bomb. Since the bomb to be detonated, when placed on the table, would be quite remote from the layer of compressible material 36, it has been found that the construction of FIGS. 3, 3*a* does not require an inner liner, comparable to liner 14 and 24 in the first two described embodiments, but such a liner may nevertheless be provided as shown at 44.

The inner compressible layer 36 in the container of FIGS. 3 and 3*a* is preferably of the same vermiculite-plaster mixture used in the previously-described embodiments. However, the container of FIGS. 3 and 3*a* further includes a wire mesh 42 embedded in the inner compressible layer 36. Mesh 42 provides additional absorption of the blast energy before transmitted to the outer housing 30.

As one example, the outer housing 30 may have a diameter of 240 cm, a height of 300 cm, and may be of steel having a thickness of 14 mm; and the inner compressible layer may be of the vermiculite-plaster or vermiculite-cement mixture described above and having a thickness of 10 cm.

What is claimed is:

1. A blast-resistant container for receiving an explosive or explosive-suspect article comprising a high-strength outer housing; characterized in that the housing includes an inner compressible layer of a mixture including vermiculite in a binder, effective to space the article from the outer housing, to absorb energy of the blast before transmitted to the outer housing, to distribute the blast forces over a larger surface area of the outer housing, and to impart resistance to the penetration of fragments to the outer housing.

2. The container according to claim 1, wherein said vermiculite has an average small-dimension particle size of from 5 to 10 mm.

3. The container according to claim 1, wherein the vermiculite and binder are present in a ratio of 2:1 to 10:1 by volume.

4. The container according to claim 1, wherein said inner compressible layer is a mixture including vermiculite and plaster.

5. The container according to claim 1, wherein said inner compressible layer is a mixture including vermiculite and cement.

6. The container according to claim 1, wherein said inner compressible layer is from 5 to 25 cm. in thickness.

7. The container according to claim 1, further including an inner liner spaced from said outer housing by said inner compressible layer.

8. The container according to claim 1, further including a wire mesh embedded in said inner compressible layer.

9. The container according to claim 1, wherein said outer housing is open at the top and includes a removable cover closing its open top.

10. The container according to claim 1, wherein said outer housing is formed with a side-opening in its side wall and includes a blast-resistant door movable to either an open position or a closed position with respect to said side opening.

11. A blast-resistant container for receiving an explosive or explosive-suspect article comprising: a high-strength outer housing; and a compressible layer disposed within said housing of a mixture including vermiculite in a binder present in a ratio of 2:1 to 10:1 by volume and effective to space the article from the outer housing, to absorb energy of the blast before transmitted to the outer housing, to distribute the blast forces over a larger surface area of the outer housing, and to impart resistance to the penetration of fragments to the outer housing.

12. The container according to claim 11, wherein said vermiculite has an average small-dimension particle size of from 5 to 10 mm.

13. The container according to claim 11, wherein said inner compressible layer is a mixture including vermiculite and plaster.

14. The container according to claim 11, wherein said inner compressible layer is a mixture including vermiculite and cement.

15. The container according to claim 11, wherein said inner compressible layer is from 5 to 25 cm. in thickness.

16. The container according to claim 11, further including an inner liner spaced from said outer housing by said inner compressible layer.

17. The container according to claim 11, further including a wire mesh embedded in said inner compressible layer.

18. A blast-resistant container for receiving an explosive or explosive-suspect article comprising: a high-strength outer housing; an inner liner; and a compressible layer of a mixture including vermiculite in a binder disposed between said outer housing and said inner liner and effective to space the article from the outer housing, to absorb energy of the blast before transmitted to the outer housing, to distribute the blast forces over a larger surface area of the outer housing, and to impart resistance to the penetration of fragments to the outer housing.

* * * * *